US011857839B2

(12) United States Patent
Liao et al.

(10) Patent No.: US 11,857,839 B2
(45) Date of Patent: Jan. 2, 2024

(54) SYSTEMS AND METHODS FOR RETROFITTING EXERCISE MACHINES WITH SMART FUNCTIONS

(71) Applicant: WISTRON CORPORATION, New Taipei (TW)

(72) Inventors: Hsin-Hui Liao, New Taipei (TW); Yi-Hsuan Cheng, New Taipei (TW); Chih Hao Chiu, New Taipei (TW); Tai-Yun Chen, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 237 days.

(21) Appl. No.: 17/358,305

(22) Filed: Jun. 25, 2021

(65) Prior Publication Data

US 2022/0409959 A1 Dec. 29, 2022

(51) Int. Cl.

| | |
|---|---|
| ***A63B 24/00*** | (2006.01) |
| ***A63B 21/005*** | (2006.01) |
| ***A63B 71/06*** | (2006.01) |

(52) U.S. Cl.

CPC ..... *A63B 24/0062* (2013.01); *A63B 21/0058* (2013.01); *A63B 24/0087* (2013.01);

(Continued)

(58) Field of Classification Search

CPC ..... A63B 24/0062; A63B 21/0058; A63B 24/0087; A63B 71/0619; A63B 2220/24;

(Continued)

(56) References Cited

U.S. PATENT DOCUMENTS

| | | | | |
|---|---|---|---|---|
| 9,414,784 | B1 * | 8/2016 | Berme | A61B 5/01 |
| 2015/0335951 | A1 * | 11/2015 | Eder | G16H 30/20 482/8 |

(Continued)

FOREIGN PATENT DOCUMENTS

| | | | |
|---|---|---|---|
| CN | 103297488 | A | 8/2014 |
| CN | 103933722 | B | 4/2016 |

(Continued)

OTHER PUBLICATIONS

European Search Report to corresponding EP Application No. 21201184.5 dated Mar. 30, 2022 (7 pages).

*Primary Examiner* — Sundhara M Ganesan
*Assistant Examiner* — Jacqueline N L Loberiza
(74) *Attorney, Agent, or Firm* — Peigen Jiang; Greenberg Traurig, LLP

(57) ABSTRACT

A method for retrofitting exercise machines includes removably attaching a sensor module to a moving part of an exercise machine, the sensor module being configured to detect movements of the moving part and transmit the detected data by a first wireless communication connection, placing a control module in a vicinity of yet separated from the exercise machine, the control module being configured to receive the detected data, calculate an angle value and a speed range using the detected data and transmit the angle value and the speed range by a second wireless communication connection, providing a remote cloud-based application server configured to receive the angle value and the speed range via the second wireless communication connection, verify a user, produce data packets based on the angle value, the speed range and the verified user information and transmit the data packets to a display device.

20 Claims, 16 Drawing Sheets

(52) U.S. Cl.
CPC ..... *A63B 71/0619* (2013.01); *A63B 2220/24* (2013.01); *A63B 2220/30* (2013.01); *A63B 2220/44* (2013.01); *A63B 2220/803* (2013.01); *A63B 2220/833* (2013.01); *A63B 2220/89* (2013.01); *A63B 2225/15* (2013.01); *A63B 2225/20* (2013.01)

(58) Field of Classification Search
CPC ..... A63B 2220/30; A63B 2220/44; A63B 2220/803; A63B 2220/833; A63B 2220/89; A63B 2225/15; A63B 2225/20
See application file for complete search history.

(56) References Cited

U.S. PATENT DOCUMENTS

| | | | | |
|---|---|---|---|---|
| 2017/0095695 | A1* | 4/2017 | Mangusson ..... | A63B 21/4047 |
| 2017/0319905 | A1* | 11/2017 | O'Connor ..... | A63B 21/00181 |
| 2018/0214729 | A1 | 8/2018 | Rubin et al. | |
| 2020/0001459 | A1 | 1/2020 | Song | |
| 2020/0179753 | A1 | 6/2020 | Redgard et al. | |
| 2020/0245900 | A1 | 8/2020 | Douglas et al. | |

FOREIGN PATENT DOCUMENTS

| | | | | |
|---|---|---|---|---|
| CN | 108492035 | A | | 9/2018 |
| CN | 110201372 | A | | 9/2019 |
| CN | 210751205 | U | * | 6/2020 |
| CN | 210751205 | U | | 6/2020 |
| KR | 10-2021-0022293 | | | 3/2021 |
| TW | I247618 | B | | 1/2006 |

* cited by examiner

SYSTEMS AND METHODS FOR RETROFITTING EXERCISE MACHINES WITH SMART FUNCTIONS

BACKGROUND

The present disclosure relates generally to the field of smart exercise machines, and, more particularly, to systems and methods for retrofitting exercise machines with smart functions.

Conventional exercise machines, particular those used for strength training in fitness centers or rehabilitation facilities, provides physical exercises for various parts of our body through repetitive movements. However, the conventional exercise machines lack monitoring and feedback functions, thus a fitness coach is often needed on site to track an exercise session and to provide guidance to a user. This is both costly and often time not practical.

On the other hand, the conventional exercise machines are a big investment and still perfectly usable to facilitate exercises. As such, what is desired is systems and methods to retrofit the conventional exercise machines with smart functions.

SUMMARY

A method for retrofitting exercise machines includes removably attaching a sensor module to a moving part of an exercise machine, the sensor module being configured to detect rotations of the moving part and transmit the detected data by a wireless communication connection with a control module, placing the control module in a vicinity of yet separated from the exercise machine, the control module being configured to receive the detected data, calculate an angle value using the detected data and transmit the angle value by a wireless communication connection, providing a cloud-based application server remote to the exercise machine, the cloud-base application server being configured to receive the angle value via the wireless communication connection, verify a user, produce packets of data based on the angle value and the verified user information and transmit the packets of data to a display device, and affixing an identification code to the exercise machine, the identification code being linked to the cloud-based application server. A retrofitted exercise machine system is further disclosed.

Figure 1:
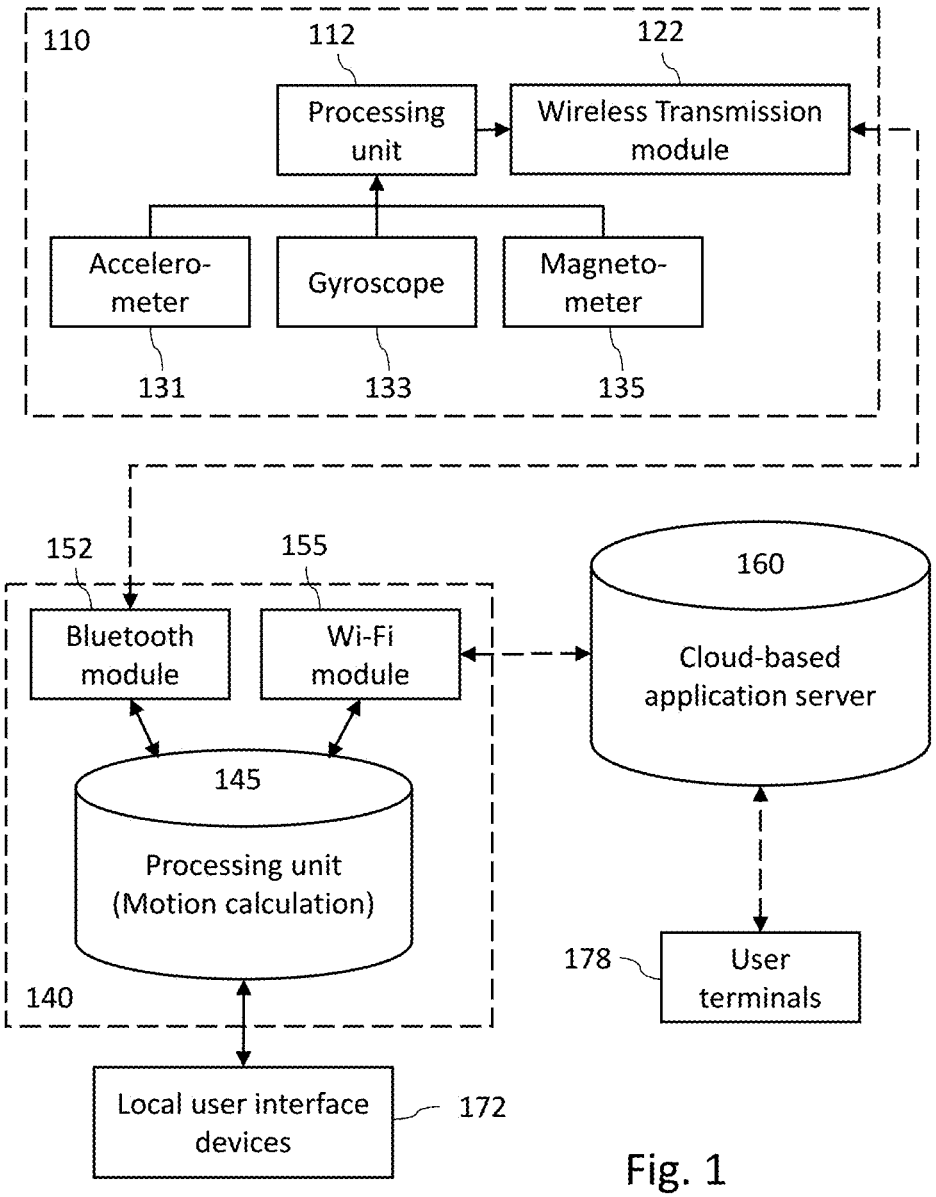
FIG. 1 is a block diagram of a system for retrofitting conventional exercise machines according to an embodiment of the present disclosure.

The drawings accompanying and forming part of this specification are included to depict certain aspects of the disclosure. A clearer conception of the disclosure, and of the components and operation of systems provided with the disclosure, will become more readily apparent by referring to the exemplary, and therefore non-limiting, embodiments illustrated in the drawings, wherein like reference numbers (if they occur in more than one view) designate the same elements. The disclosure may be better understood by reference to one or more of these drawings in combination with the description presented herein.

DESCRIPTION

The present disclosure relates to retrofitting conventional exercise machines with smart functions. Preferred embodiments of the present disclosure will be described hereinafter with reference to the attached drawings.

FIG. 1 is a block diagram of a system for retrofitting conventional exercise machines according to an embodiment of the present disclosure. The retrofitting system includes a sensor module 110, a control module 140, a cloud-based application server 160, local user interface devices 172 and remote user terminals 178. The sensor module 110 is to be mounted on a moving part of a designated exercise machine by a specially designed fixture, such as a clip or a magnet, to detect motions of the machine part. As the sensor module 110 is removable, the sensor module 110 can also be secured to a user's body part by an exemplary strap to detect body movements directly. In an embodiment, the senor module 110 includes an accelerometer 131, a gyroscope 133, a magnetometer 135, a processing unit 112 and a wireless transmission module 122. The accelerometer 131, the gyroscope 133, and the magnetometer 135 together can detect the exercise machine part's linear distance and angle of movement. The processing unit 112 collects data sampled by the accelerometer 131, the gyroscope 133, and the magnetometer 135 and transforms the sampled raw data into acceleration, angular acceleration, magnetic value and quaternion data for being transmitted by the wireless transmission module 122. In an embodiment, the wireless transmission module 122 is implemented with Bluetooth technology and the data transmission is in packet form. However, other wireless transmission technologies, such as infrared communication, broadcast radio, microwave communication, mobile communication and Wi-Fi communication, may also be used to implement the wireless transmission module 122.

When an exercise machine has multiple moving parts, multiple sensor module 110 may be used, so that each moving part has its own sensor module 110. In addition, a typical fitness facilities may have multiple exercise machines, and every machine may have its own set of sensor modules 110. In order to identify each sensor module 110, an identification number may be assigned to it. The identification number may be set by the factory and can be read out by the control module 140, or can be dynamically written into its local storage by the control module 140, which is placed in a vicinity of multiple sensor modules 110 and wirelessly communicates therewith through Bluetooth technology.

Referring again to FIG. 1, the control module 140 includes a processing unit 145, a Bluetooth module 152, and an exemplary Wi-Fi module 155. The Bluetooth module 152 and the wireless transmission module 122 of the sensor module 110 establish a wireless communication connection for receiving data from and transmitting commands to the sensor module 110. The Wi-Fi module 155 is used to wirelessly communicates the control module 140 with the cloud-based application server 160 through the Internet. In an embodiment, a single wireless communication module can be used in place of both the Bluetooth module 152 and the Wi-Fi module 155. In such case, the control module 140 communicates with both the sensor module 110 and the cloud-based application server 160 using Wi-Fi technology. The control module 140 is exemplarily placed on a ground near yet separated from the exercise machine or placed on the exercise machine. A control module 140 may be associated with one exercise machine or multiple exercise machines depending on a number of sensor modules 110 the exercise machines have. In a large fitness facility where multiple exercise machines may be scattered in different rooms, multiple control modules 140 may be used. In this case, a local computer (not shown) may be used to control and communicate with the multiple control modules 140 through either wireless Bluetooth or ethernet cables. The local computer serves as a gateway to communicate with the cloud-based application server 160.

The processing unit 145 receives the acceleration, angular acceleration, magnetic value and quaternion data from the sensor module 110, and calculates an angle of rotation and angular acceleration of a corresponding machine part based on the received data. In addition, the processing unit 145 also detects a speed range of the corresponding machine part based on the received data. The angle of rotation, the angular acceleration and the speed range are then transmitted to the cloud-based application server 160 through the exemplary Wi-Fi module 155.

As shown in FIG. 1, the processing unit 145 is also coupled to local user interface devices 172, such as a display with touch sensing inputs. A user can sign up or log into his or her account through the local user interface devices 172. For such purposes, the local user interface devices 172 may have a touch sensing screen as well as a QR code scanner, a card reader and/or a wearable device sensor. Once logged in, the local user interface devices 172 allows the user to instantly monitor his or her workout characteristics, such as range of motion and cadence, etc. These characteristics may be compared with predetermined targets. The local user interface devices 172 also allows the user to set the targets or acquiring training programs from the cloud-base application server 160. As such, each exercise machine may associate with a local user interface device 172 placed nearby for individual use. The local user interface device 172 may also include a large display and associate with multiple exercise machines to facilitate group workouts.

Referring again to FIG. 1, the cloud-based application server 160 serves as a management platform for the smart exercise machine system according to embodiments of the present disclosure. The management platform provides a website that is hosted by a cloud service providers, such as Amazon Web Services and Microsoft Azure Cloud Provider, etc. The website can be accessed by the user terminals 178 from anywhere with an Internet connection. The website offers numerous training and management operations, such as real-time coaching, series of classes, training information dashboard, trainee's training records, training organizing and planning, administrator's access, facility management, machine management, and agent management, etc. As an example, the real-time training guidance can stream video and/or audio content to the local user interface devices 172, so that the user can follow a selected workout routine. At the same time the corresponding sensor module 110 can monitor the user's performance in real-time for comparing with the selected workout routine. Then the user interface devices 172 displays progresses by the user, such as how many repetitions the user has performed and how many to go.

The cloud-based application server 160 may also host user account records accessible through the website. The user account records may store user's contact information, training logs, physical fitness test records, personal profiles, user sign-in information and user's biometric data. In addition, the cloud-based application server 160 may provide a web portal for facility management personnel, so that they can monitor the machine usages and coaching activities.

In embodiments, the cloud-based application server 160 may be linked to users' social media accounts, such as LINE accounts, so that their fitness activities can be shared through social media; family members can monitor their workouts in real time; and their training and coaching records can be easily accessed. By linking to social media accounts, the users can also talk to or share video with each other during exercise. In addition, family members can access a user's physical fitness record and biometric data through the social media account.

Figure 2:
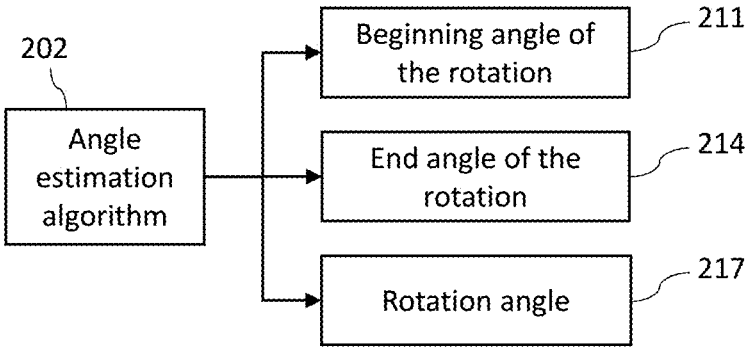
FIG. 2 illustrates an angle calculation method performed by the processing unit in the control module of FIG. 1.

FIG. 2 illustrates an angle calculation method performed by the processing unit 145 in the control module 140. The angle estimation algorithm 202 uses the acceleration, angular acceleration, magnetic value and quaternion data from the sensor module 110 to calculate the turning angle of a corresponding machine part. From the calculated turning angle, an angle position of the beginning rotation 211, an angle position of the end rotation 214 and a rotation angle 217 are obtained.

The angle position of the beginning rotation 211 and the angle position of the end rotation can be calculated from the quaternion data. If the axis of rotation around the quaternion is a normalized vector (ax, ay, az), the rotation angle is θ, then the (w, x, y, z) component of the quaternion is: $(ax \cdot \sin(\theta/2), ay \cdot \sin(\theta/2), az \cdot \sin(\theta/2), \cos(\theta/2))$.

The rotation angle can be calculated from the angular acceleration data by an equation: Angle=V*T, where V is a current angular acceleration value, and T is a sample rate of the sensor module 110. As an example, T is set at 200 ms.

In an embodiment, a nine-axis sensor module may be used to detect three-axis acceleration, three-axis angular acceleration, three-axis magnetic value and quaternion data. The quaternion data is derived from the acceleration, the angular acceleration, and the magnetic value data. Below Table illustrates relationships of these measurement data.

TABLE I

| Type | Data | Unit |
|---|---|---|
| 3-axis angular acceleration | X-axis angular acceleration | Radian/sec$^2$ |
| | Y-axis angular acceleration | Radian/sec$^2$ |
| | Z-axis angular acceleration | Radian/sec$^2$ |
| Quaternion | a + bi + cj + dk | i^{2} = j^{2} = k^{2} = i * j * k = −1 |

From the angle calculation result, completeness of a workout repetition can be derived. The completeness is defined as a ratio or percentage of the actual rotation angle to a predetermined maximum rotation angle for a particular machine part. The predetermined maximum rotation angle is stored in either the control module 140 or the cloud-based application server 160.

Figure 3:
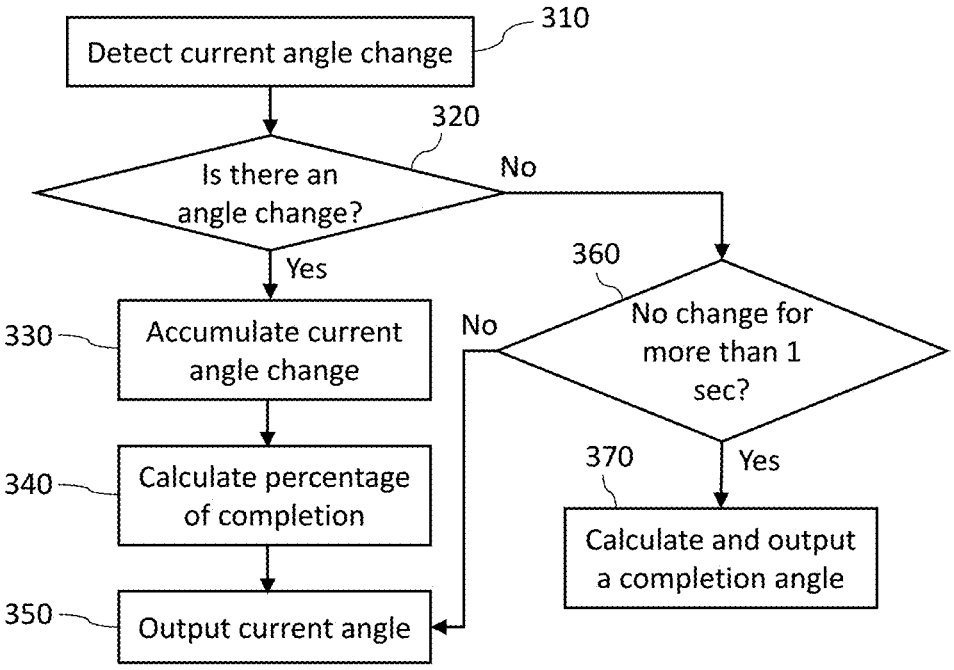
FIG. 3 is a flowchart illustrating a process of detecting completeness of a workout repetition according to an embodiment of the present disclosure.

FIG. 3 is a flowchart illustrating a process of detecting completeness of a workout repetition according to an embodiment of the present disclosure. The process begins with block 310 where current angle change is detected. In block 320, the detection result is evaluated. If there is an angle change, the process enters block 330 where the current angle change is accumulated. In subsequent block 340, a percentage of completion is calculated. In block 350, the current angle is outputted to either the local user interface devices 172 or the cloud-based application server 160, or both—in real time.

Back to block 320, if there is no angle change, the process starts a timer in block 360. If the timer expires after a predetermined time, for instance, 1 second, there is still no angle change being detected, the process enters block 370 where a completion angle is calculated and outputted to either the local user interface devices 172 or the cloud-based application server 160 in real time, or both—in real time.

Figure 4A:
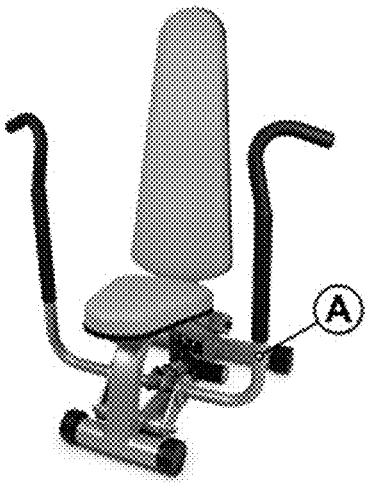
FIGS. 4A-4C illustrate various locations the sensor modules 110 are attached to different exercise machines.
Figure 4B:
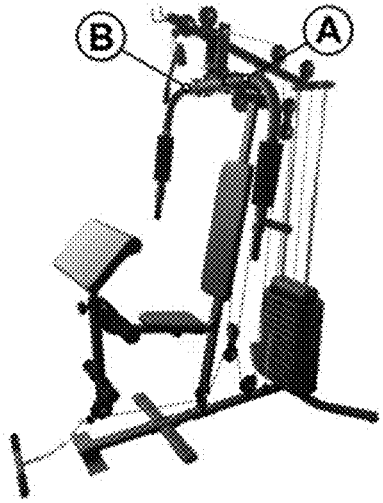
Figure 4C:
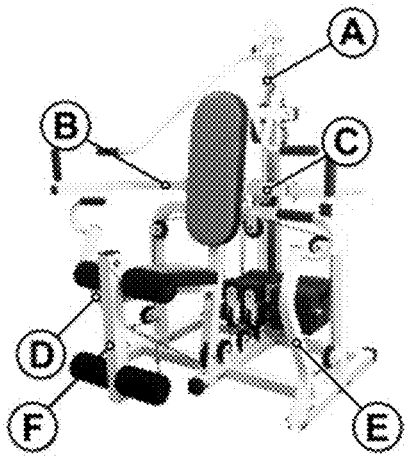

FIGS. 4A-4C illustrates various locations the sensor modules 110 are attached to different exercise machines. Referring to FIG. 4A, for a simple arm press machine on which both arms move synchronously, only one sensor module 110 is needed to be mounted at location A which reflects angular changes of a handle.

Referring to FIG. 4B, for a chest expansion machine, as the left and right arm may move asynchronously, two sensor modules 110 are needed with one mounted at location A on a left arm part and the other mounted at location B on a right arm part.

Referring to FIG. 4C, a combinational machine has multiple moving parts, multiple sensor modules 110 are mounted at locations A, B, C, D, E, and F, each corresponds to a moving part.

During a setup process, each sensor module 110 is identified by an identification number or code and associated with the exercise machine the sensor module 110 is mounted to.

Figure 5:
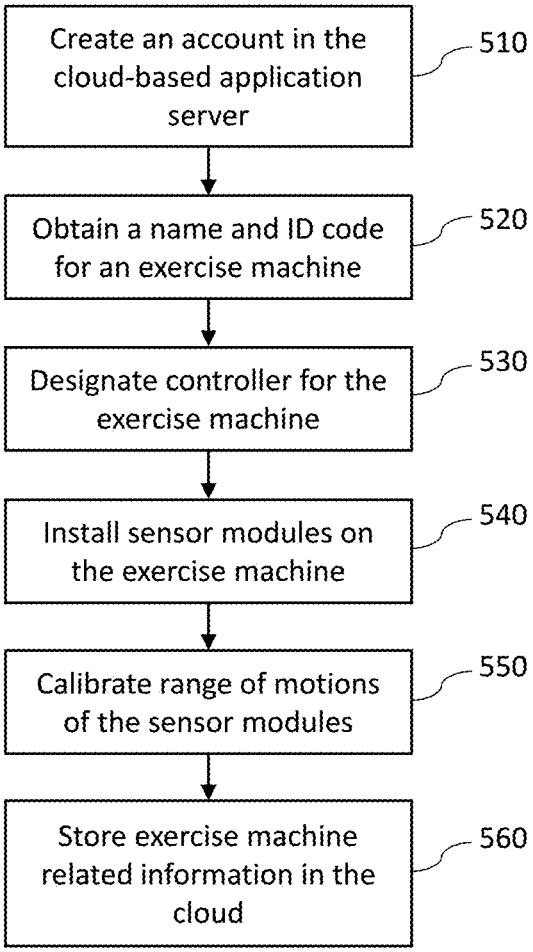
FIG. 5 is a flowchart illustrating a process of retrofitting an exercise machine with the smart system of the present disclosure.

FIG. 5 is a flowchart illustrating a process for retrofitting an exercise machine with the smart system of the present disclosure. The retrofitting process begins with block 510 where a purchaser first creates an account in the cloud-based application server 160. After signing up, in block 520, the purchaser obtains a name and identification code for a particular exercise machine that is intended to be retrofitted with the smart functions. In block 530, a control module 140 is designated to the exercise machine. The control module 140's universal unique identifier (UUID) is then provided to the cloud-based application server 160. In block 540, sensor modules 110 are installed on the exercise machine. Identification number or code of each of the installed sensor modules 110 are obtained and provided to the cloud-based application server 160. In block 550, range of motions of the installed sensor modules are calibrated. The calibration includes detecting and recording a starting angle and an end angle. In block 560, information relates to the retrofitted exercise machine, such as the facility identification, the machine identification, the control module 140's UUID and the sensor module 110's starting angle and end angle, are stored in the cloud-base application server 160.

Figure 6:
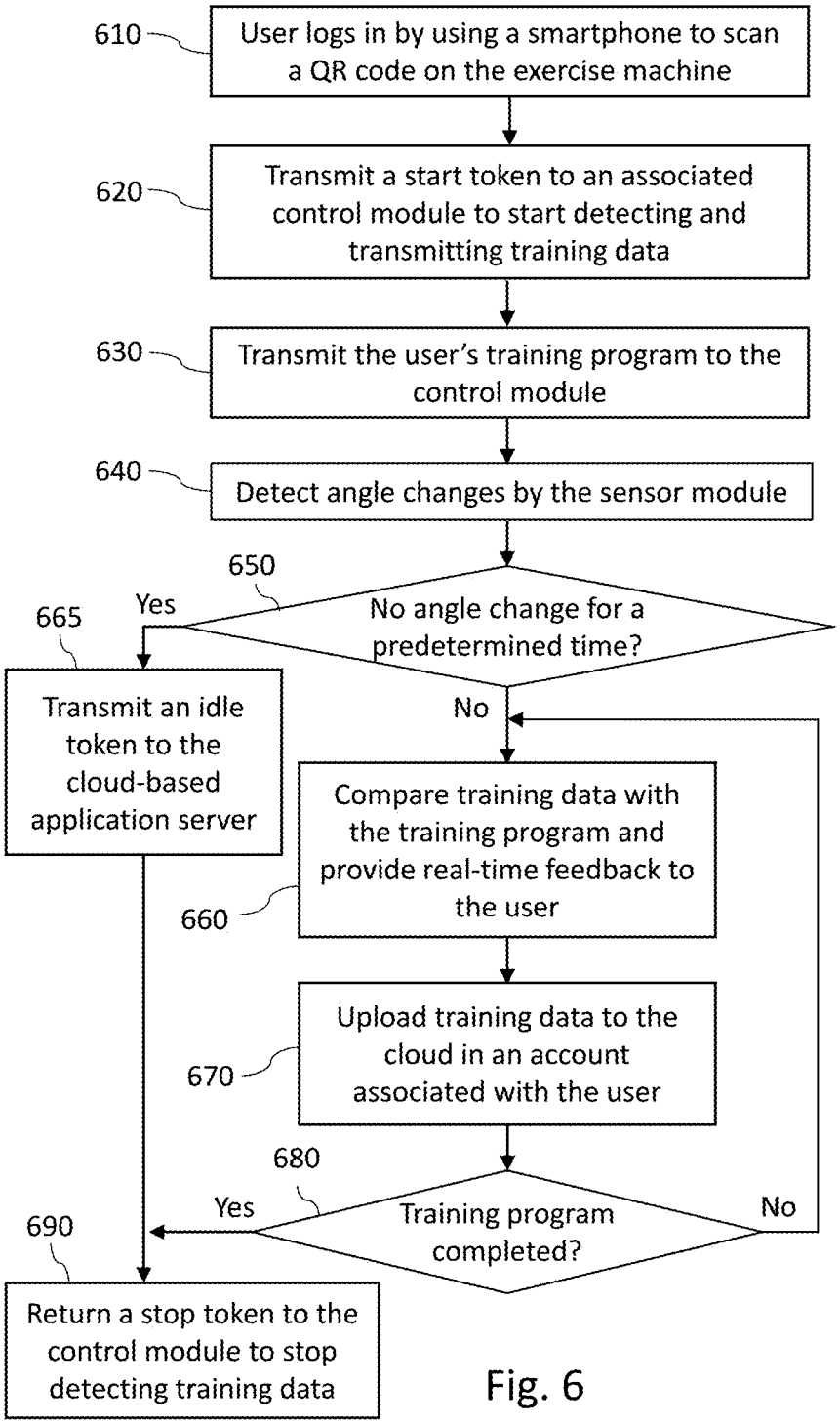
FIG. 6 is a flowchart illustrating a process of using the retrofitted smart exercise machine.

FIG. 6 is a flowchart illustrating a process of using a retrofitted smart exercise machine. To begin using the smart exercise machine, a user uses his or her smartphone to scan a quick response (QR) code or universal product code (UPC) affixed on the exercise machine in block 610. The log-in process also include transmitting the user identity information along with the exercise machine's identification code to the cloud-based application server 160. If the user is not a registered customer, and the cloud-based application server 160 does not recognize the user, then the smart functions will not be activated, so the user can only use the exercise machine as a conventional one. If the user is a registered customer, then the cloud-based application server 160 transmits a start token to a control module 140 associated with the exercise machine to start detecting and transmitting training data in block 620. Upon request, the cloud-based application server 160 also transmits a prestored training program for the user to the control module 140 in block 630. In block 640, the control module 140 detects angle changes as a result of the user's workout by the sensor module 110. In block 650, a timer tracks time durations of angle changes. If there is no angle change for a predetermined time, for instance 10 minutes, the control module 140 transmits an idle token to the cloud-based application server 160 in block 665. Upon receiving the idle token, the cloud-based application server 160 returns a stop token to the control module 140 to stop further detecting training data in block 690. On the other hand, if the angle changes during the predetermined time duration, meaning that the user is still working out on the exercise machine, the control module 140 compares the detected training data with the training program and provide real-time feedback to the user on the local user interface devices 172 in block 660. The control module 140 also uploads the training data to the cloud-based application server 160 in an account associated with the user in block 670. In block 680, the control module checks if the training program is completed? If completed, the training session ends and cloud-based application server 160 performs block 690. Otherwise, the training process returns to block 660.

Figure 7:
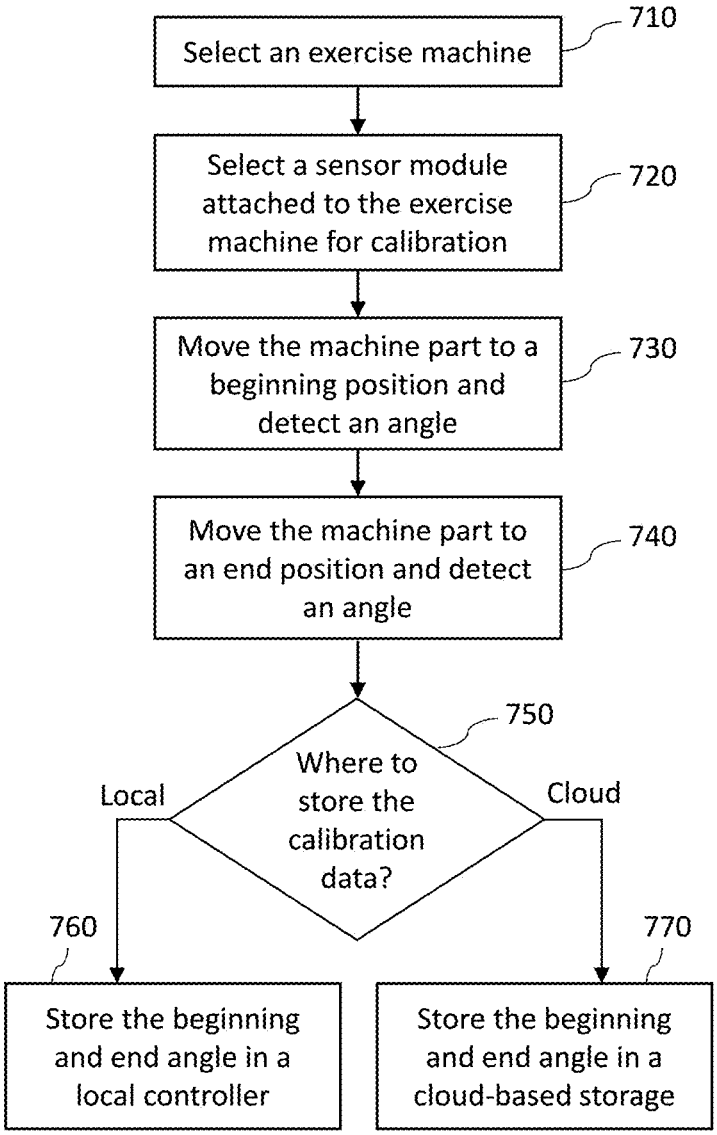
FIG. 7 is a flowchart illustrating a calibration process for a retrofitted exercise machine.

FIG. 7 is a flowchart illustrating a calibration process for a retrofitted exercise machine. The calibration process begins with selecting an exercise machine in block 710. Then select a sensor module 110 that is attached to a moving part of the exercise machine for calibration in block 720. In block 730, the moving part is moved to a beginning position and an angle is detected. In block 740, the moving part is moved to an end position and an angle is detected again. In block 750, the operator is prompted to select where to store the calibration data? If "local" is selected, the beginning and end angle are then stored in the local control module 140. If "cloud" is selected instead, the beginning and end angle are then stored in the cloud-based application server 160. In another embodiment, the beginning and end angle are stored in both the local control module 140 and the cloud-based application server 160. In yet another embodiment, the beginning and end angle are first stored in the local control module 140, and then optionally stored in the cloud-based application server 160.

Figure 8:
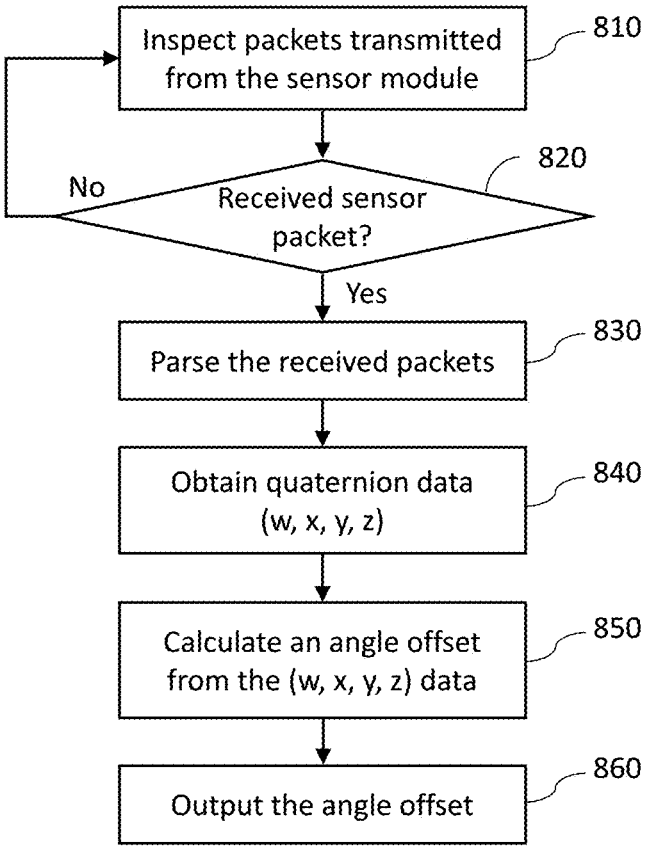
FIG. 8 is a flowchart illustrating a process of detecting angles by the control module.

FIG. 8 is a flowchart illustrating a process of detecting angles by the control module 140. In block 810, the control module 140 inspects packets transmitted from the sensor module 110. In block 820, if no sensor packet is received, the control module 140 keep inspecting the incoming packets in block 810; if sensor packets are received, the control module 140 parse the received packets in block 830, and obtain quaternion data (w, x, y, z) from the sensor packets in block 840. In block 850, the control module calculates an angle offset. In block 860, the calculated angle offset is outputted to the cloud-based application server 160 or the local user interface devices 172 or both.

Figure 9:
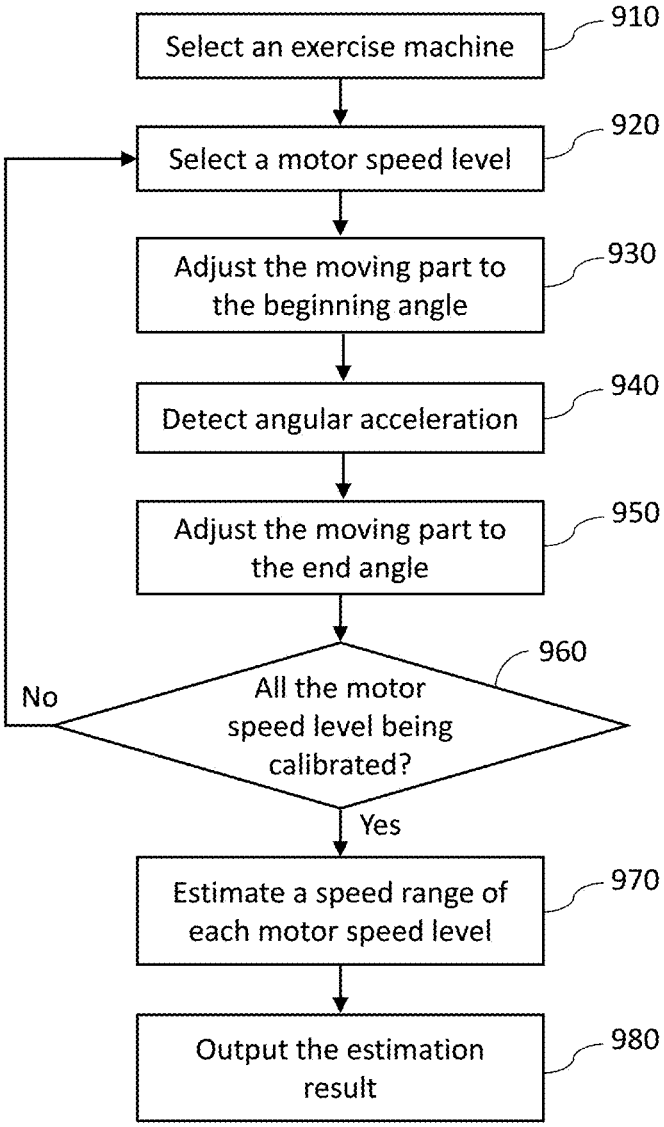
FIG. 9 is a flowchart illustrating a process of determining a speed range of each motor speed level according to embodiments of the present disclosure.

FIG. 9 is a flowchart illustrating a process of determining a speed range of each motor speed level according to embodiments of the present disclosure. In block 910, an operator selects an exercise machine to be calibrated. In block 920, a motor speed level is selected. In block 930, the operator adjusts a moving part of the exercise machine to its beginning angle. In block 940, the control module 140 detects angular acceleration of the moving part. In block 950, the operator adjusts the moving part to its end angle. In block 960, after the calibration for one speed level is completed, the process goes back to block 920 to perform calibration for another speed level until all the speed levels are calibrated. In block 970, the control module estimates a speed range of each motor speed level. In block 980, the estimated result is outputted to the local user interface devices 172. If selected, the estimated result is further outputted to the cloud-based application server 160.

Table II shows an exemplary result of motor speed level vs speed range. In this case, there are six motor speed level corresponding to six speed ranges each with a maximum speed and a minimum speed

TABLE II

| Motor speed level | Minimum speed | Maximum speed |
|---|---|---|
| Level 1 | Lv1_min | Lv1_max |
| Level 2 | Lv2_min | Lv2_max |
| Level 3 | Lv3_min | Lv3_max |
| Level 4 | Lv4_min | Lv4_max |
| Level 5 | Lv5_min | Lv5_max |
| Level 6 | Lv6_min | Lv6_max |

Figure 10:
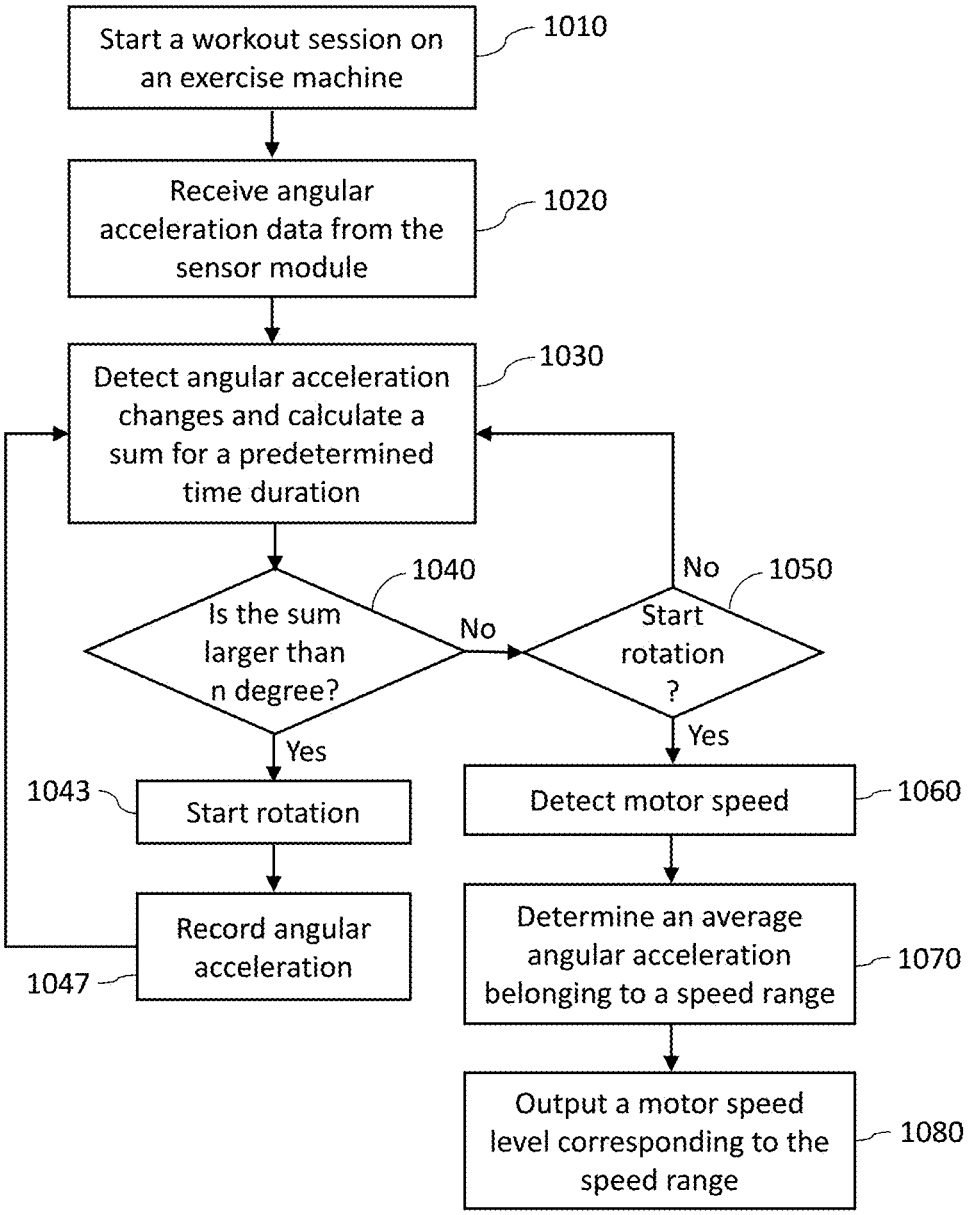
FIG. 10 is a flowchart illustrating a process of detecting motor speed levels during a workout session according embodiments of the present disclosure.

FIG. 10 is a flowchart illustrating a process of detecting motor speed levels during a workout session according embodiments of the present disclosure. In block 1010, a user starts a workout session on an exercise machine. In block 1020, the control module 140 receives angular acceleration data from the sensor module 110. In block, the control module 140 detects angular acceleration changes and calculates a sum for a predetermined time duration, such as 1 second. In block 1040, if the sum is larger than n degree, where n is an empirical threshold value predetermined based on a sensibility of smart exercise machine, the process enters block 1043, where rotation is detected. In block 1047, angular acceleration is recorded and then return back to block 1030. If the sum is not larger than n degree, the process enters block 1050, i.e., when the exercise machine has not started operation, the process returns to block 1030; when the operation has started, the sensor module 110 detects motor speed in block 1060. When a stop is detected, the current motor rotation speed is calculated through a detecting motor speed algorithm. In block 1070, the control module 140 determines an average angular acceleration belonging to a speed range. In block 1080, the control module 140 outputs a motor speed level corresponding to the speed range to the cloud-based application server 160 or the local user interface devices 172 or both.

For an exercise machine used for rehabilitation, the detected angular acceleration during a rotation has two situations. In a first situation, the angular acceleration is caused by both a motor and a user's force. In a second situation, the angular acceleration is only caused by the motor. In order to correctly detect actual motor speed, the second situation has to be extracted from the first situation. In an embodiment, the actual motor speed is detected using following method.

$$\text{If } \delta_{angular\ acceleration\ within\ a\ second} > m \qquad \text{Equation (1)}$$

where, δ stands for standard deviation, and in is an empirical threshold value adjustable based on the sensitivity of the exercise machine, and when a start of rotation is detected, angular accelerations that satisfies Equation (1) at two time spots, t1 and t2, where a last measurement of the angular acceleration before the rotation stops takes place at t2, are detected and recorded. Then $$\text{Motor speed} = \sum_{t1}^{t2} \frac{\text{Accumulative angular accelerations}}{(t2 + t1 + 1)} \qquad \text{Equation (2)}$$

Figure 11:
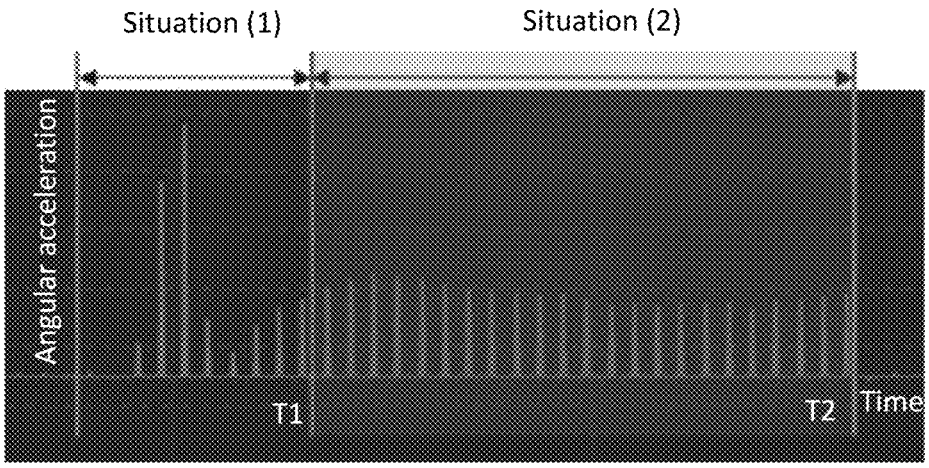
FIG. 11 is a measurement plot of angular acceleration vs. time.

FIG. 11 is a measurement plot of angular acceleration vs. time. The measurement is performed on a retrofitted smart exercise machine having two independent sensor modules 110. Up to time T1, the angular acceleration measurements fluctuates dramatically, i.e., sequential measurements differ more than a predetermined threshold. This indicates that the exercise machine is in situation (1) where the angular acceleration is caused by both a motor and a user's force. For motor speed level detection, situation (1) is ignored. Between time T1 and T2, the angular acceleration measurement become smooth. This period is viewed as in situation (2) where the angular acceleration is only caused by the motor, and correct motor speed level can be detected. Equation (1) can be used to separate situation (2) from situation (1).

Figure 12:
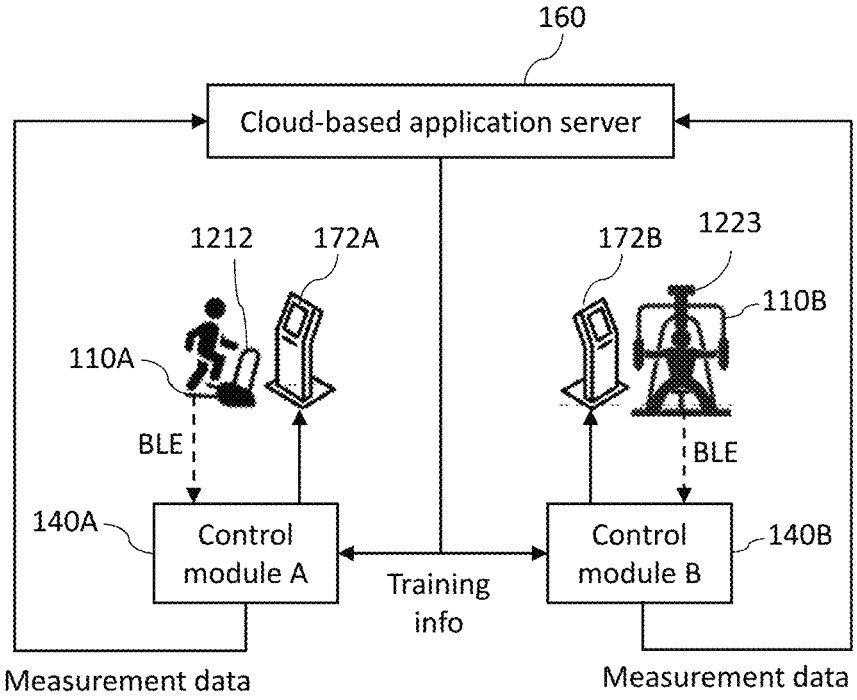
FIG. 12 is a block diagram illustrating a retrofitted smart exercise machine system with two control modules separately controlling their respective exercise machines.

FIG. 12 is a block diagram illustrated a retrofitted smart exercise machine system with two control modules 140A and 140B separately controlling their respective exercise machines 1212 and 1223. An exemplary sensor module 110A is removably attached to the exercise machine 1212, and transmits sensor data to the control module 140A via a Bluetooth low energy (BLE) connection. The control module 140A calculates the sensor data into desired measurement data, such as angle values, and transmits the measurement data to the cloud-based application server 160 via a Wi-Fi connection. Based on the measurement data and prestored training programs, the cloud-based application server 160 returned training guidance information back to the control module 140A, which in turn displays the information on a local user interface device 172A. Similarly, an exemplary sensor module 110B is removably attached to the exercise machine 1223, and transmits sensor data to the control module 140B via a Bluetooth low energy (BLE) connection. The control module 140B calculates the sensor data into desired measurement data, such as angle values, and transmits the measurement data to the cloud-based application server 160 via a Wi-Fi connection. Based on the measurement data and prestored training programs, the cloud-based application server 160 returned training guidance information back to the control module 140B, which in turn displays the information on a local user interface device 172B.

Figure 13:
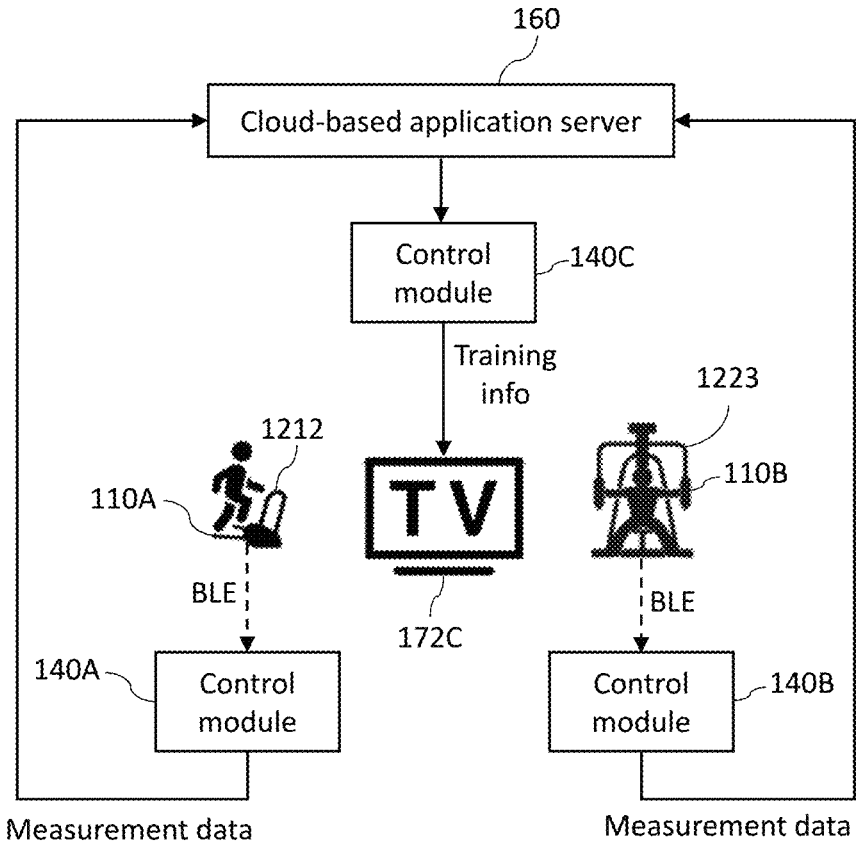
FIG. 13 is a block diagram illustrating a retrofitted smart exercise machine system with two exercise machines sharing one big screen display.

FIG. 13 is a block diagram illustrating a retrofitted smart exercise machine system with two exercise machines 1212 and 1223 sharing one big screen display. Different from the system shown in FIG. 12, the two exercise machines 1212 and 1223 of FIG. 13 do not have their own local user interface devices, instead they share a big screen local user interface device 172C which is controlled by a control module 140C. The control module 140C receives training guidance information for users of both exercise machines 1212 and 1223 from the cloud-based application server 160.

Figure 14:
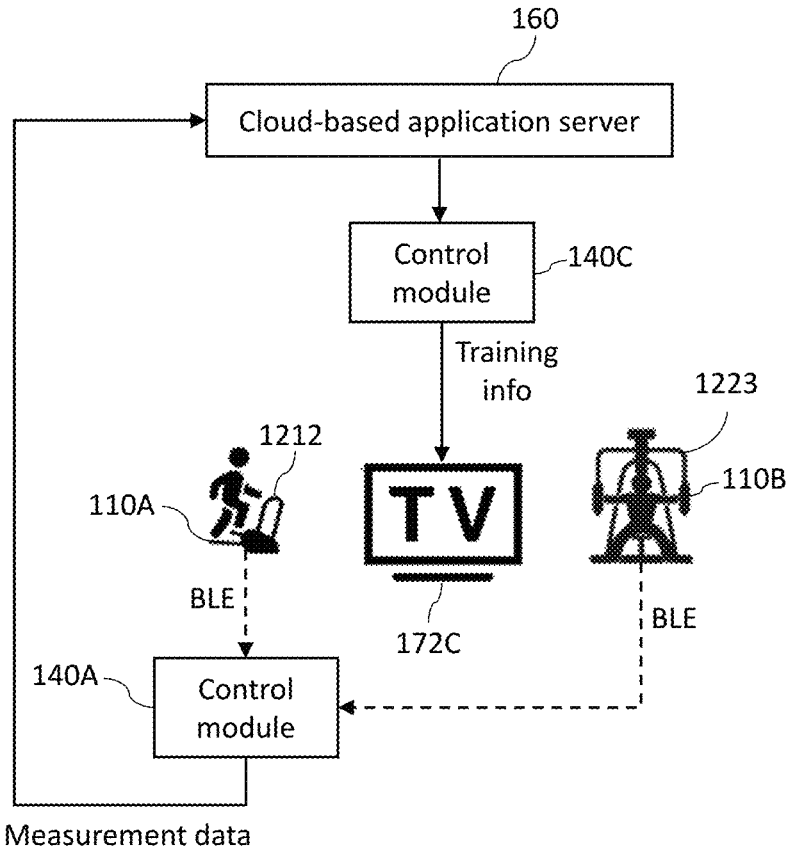
FIG. 14 is a block diagram illustrating a retrofitted smart exercise machine system with two exercise machines sharing one control module.

FIG. 14 is a block diagram illustrating a retrofitted smart exercise machine system with two exercise machines 1212 and 1223 sharing one control module 140A. Different from the system shown in FIG. 13, the two exercise machines 1212 and 1223 of FIG. 14 are placed near each other thus share a common control module 140A.

Figure 15A:
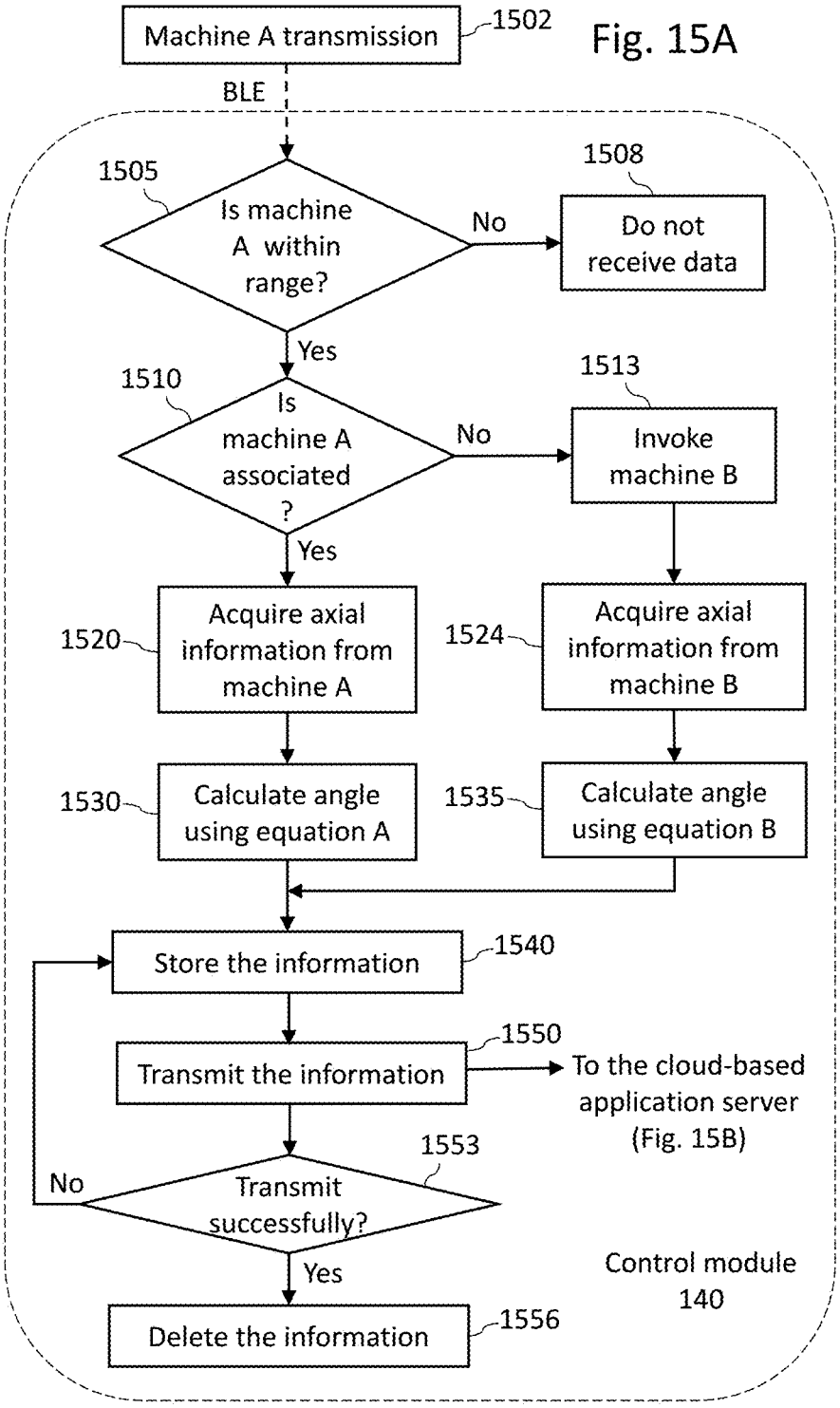
FIGS. 15A and 15B are flowcharts illustrating data flow during a user's exercise session on the retrofitted smart exercise machine system of the present disclosure.
Figure 15B:
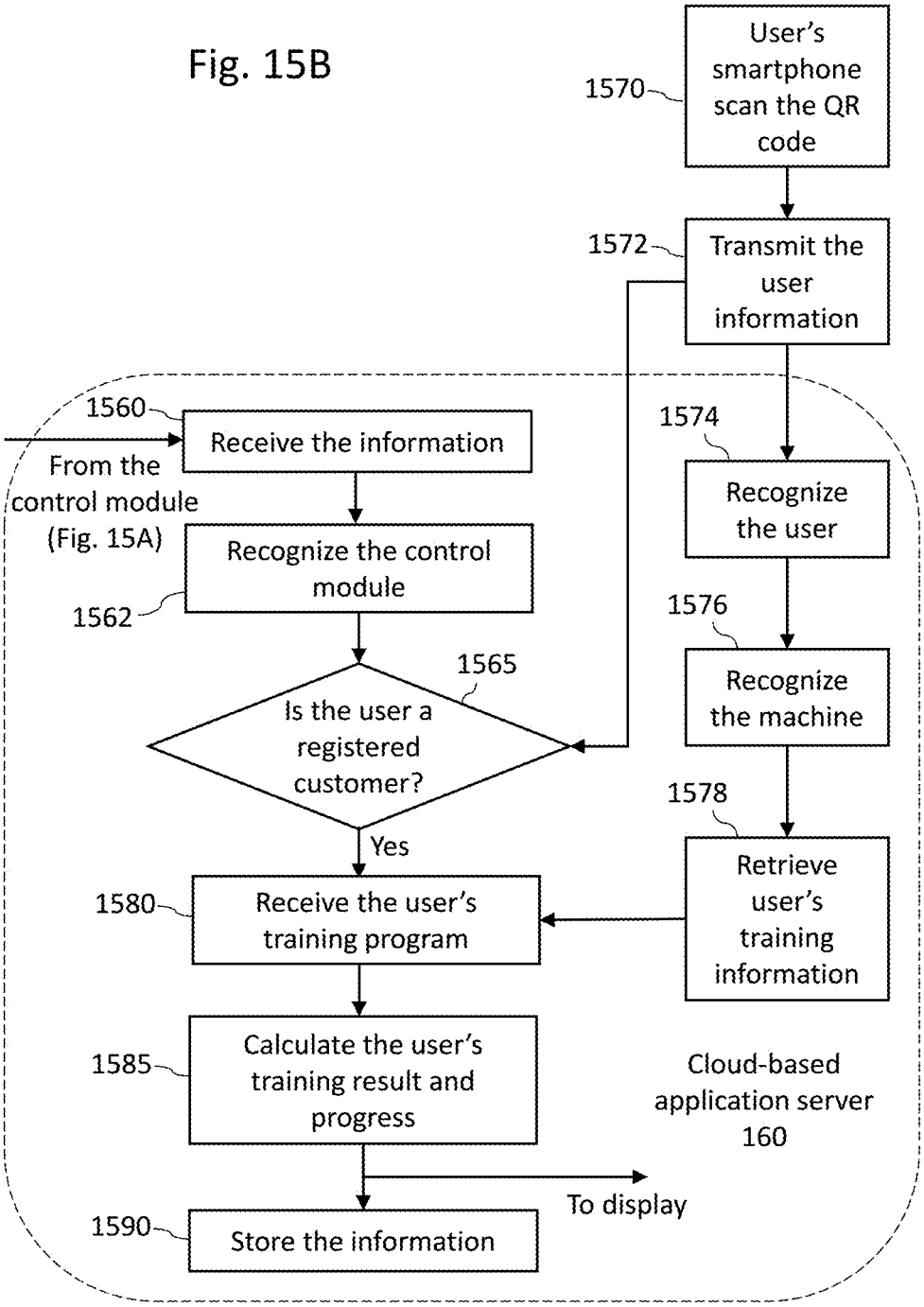

FIGS. 15A and 15B are flowcharts illustrating data flow during a user's exercise session on the retrofitted smart exercise machine system of the present disclosure. Referring to FIG. 15A, in block 1502, when a user chooses machine A for workout, machine A transmits a signal. In block 1505, the control module 140 inquires if machine A that transmits the signal is within its range? If not, the control module 140 does not receive data in block 1508. If yes, the control module inquires if machine A is associated in block 1510. In block 1520, when machine A is associated with the control module 140, the control module 140 acquires axial information from machine A. In block 1530, the axial information is used to calculate angle using equation A which is associated with machine A. In block 1540, the calculated angle is stored, and in block 1550, transmitted to the cloud-based application server shown in FIG. 15B. In block 1553, the transmission is inspected. If successful, the angle information is deleted in block 1556; if not successful, the control module 140 goes back to block 1540 and perform transmission again in block 1550.

Referring again to FIG. 15A, if, in block 1510, machine A is found to be not associated with the control module 140, machine B is invoked in block 1513. In block 1524, the control module 140 acquires axial information from machine B. In block 1535, the axial information is used to calculate angle using equation B which is associated with machine B. Because machine B may be different from machine A, equation B may be different from equation A. Then the calculated angle of machine B is stored in block 1540 and transmitted to the cloud-based application server 160 shown in FIG. 15B.

Referring to FIG. 15B, after receiving the angle information from the control module 140 of FIG. 15A in block 1560, the cloud-based application server 160 recognizes the control module in block 1562. In block 1570, when the user choose machine A for workout, he or she uses a smartphone to scan a QR code affixed to machine A. Then in block 1572, the user information is transmitted to the cloud-based application server 160. If the user is a registered customer in block 1565, the user's training program is received in block 1580. The user's training result and progress from the angle information is calculated in block 1585, and stored in block 1590. The user's training result and progress may also be provided for display in a local user interface device 172 (not shown in FIG. 15B).

Referring again to FIG. 15B, the cloud-based application server 160 recognizes the user in block 1574, and recognizes the exercise machine in block 1576. In block 1578, the prestored user's training information is retrieved for use in block 1580.

Figure 16A:
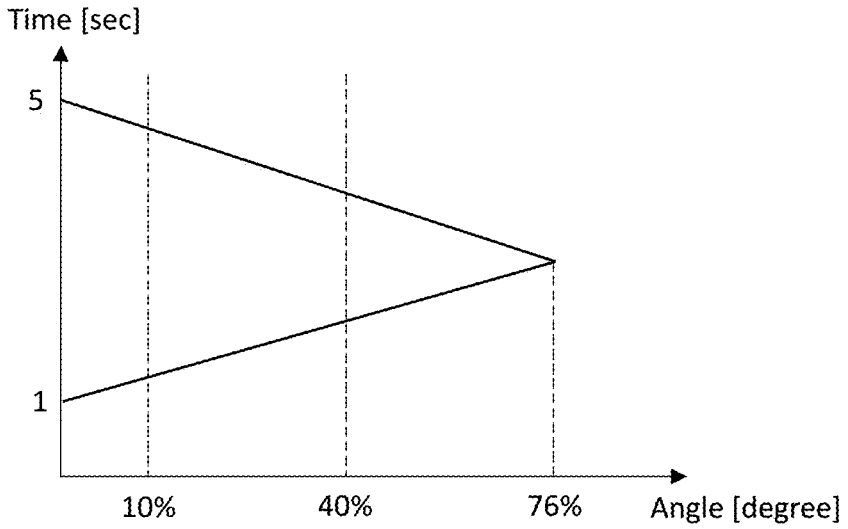
FIGS. 16A-16D illustrate exemplary training results vs. training guidance.

FIGS. 16A-16D illustrate exemplary training results vs. training guidance. Referring to FIG. 16A, a horizontal axis represents measured angle in degrees executed by a user; and a vertical axis represents a recorded time in seconds. The user starts moving at 1 second and reaches 76% of a total range of motion, and then returns to starting point at 5 second. As an example, a training guidance sets minimum angle at 10% and maximum angle at 40% of the total range of motion. Therefore, FIG. 16A shows that the user have completed a repetition.

Figure 16B:
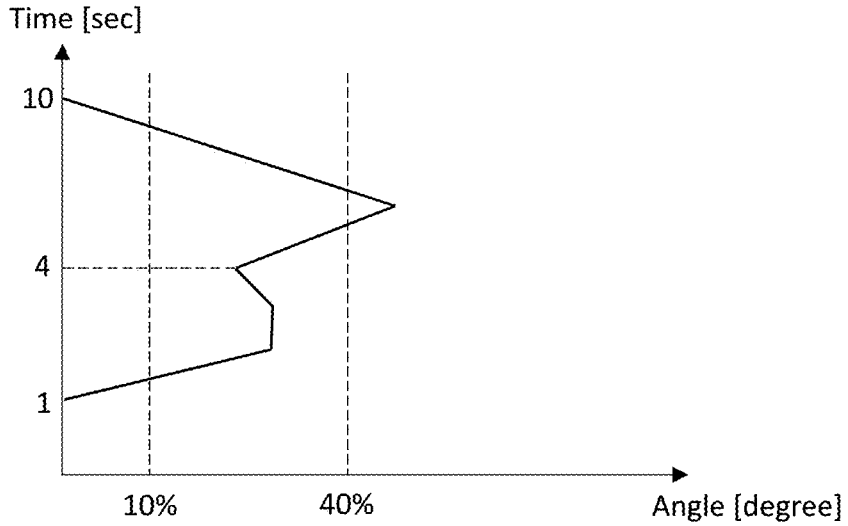

Referring to FIG. 16B, even though the user hesitates and drops the moving angle at around 4 second, he or she eventually reaches above the 40% of the total range of motion and returns to the starting point at 10 second. This case is still regarded as a repetition completed.

Figure 16C:
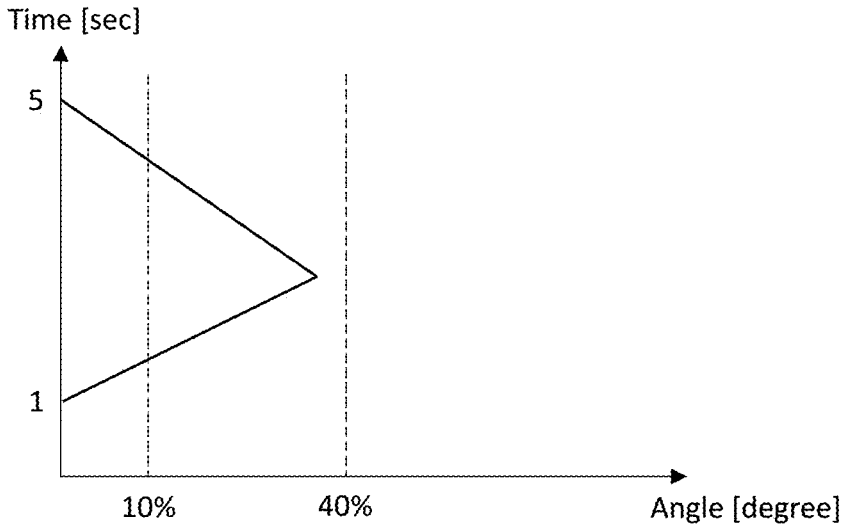

Referring to FIG. 16C, the user never reaches 40% of the total range of motion, therefore, this case is regarded as a repetition not completed.

Figure 16D:
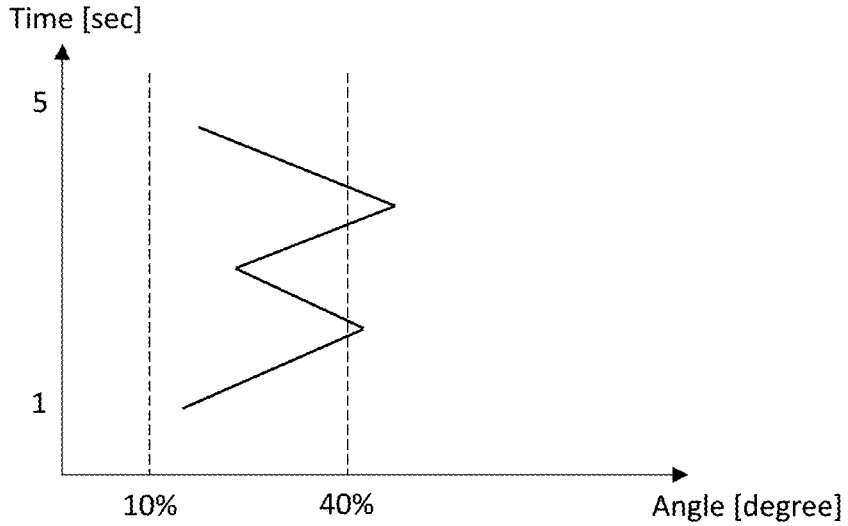

Referring to FIG. 16D, even though the user reaches above the 40% of the total range of motion, he or she does not return to below 10% of the total range of motion. This case is also regarded as a repetition not completed.

Although the disclosure is illustrated and described herein as embodied in one or more specific examples, it is nevertheless not intended to be limited to the details shown, since various modifications and structural changes may be made therein without departing from the spirit of the disclosure and within the scope and range of equivalents of the claims. Accordingly, it is appropriate that the appended claims be construed broadly and, in a manner, consistent with the scope of the disclosure, as set forth in the following claims.

What is claimed is:

1. A physical exercise system, comprising:

a first sensor module removably attached to a first moving part of a first exercise machine, the first sensor module being configured to detect movements by the first moving part and transmit the detected data by a first communication connection, wherein the detected data includes angular acceleration changes of the moving part for determining a speed level of a motor that drives the moving part;

a control module placed in a vicinity, yet separated from the first exercise machine, the control module being configured to receive the detected data, calculate a first movement value using the detected data and transmit the first movement value to a display device, and the control module being further configured to compare the angular acceleration changes with a predetermined threshold.

2. The physical exercise system of claim 1, wherein the first sensor module includes an accelerometer unit, a gyroscope unit and a magnetometer unit.

3. The physical exercise system of claim 1, wherein the first movement value is an angle of rotation or a speed range of the first moving part calculated using quaternion data transmitted from the first sensor module.

4. The physical exercise system of claim 1, wherein the control module is configured to detect angular accelerations by the first sensor module when the first moving part is adjusted to a beginning angle and an end angle.

5. The physical exercise system of claim 1, wherein the control module is configured to calculate a sum of the angular acceleration changes for a predetermined time duration, calculate an average angular acceleration from the sum, and determine the motor speed level corresponding to a speed range associated with the average angular acceleration.

6. The physical exercise system of claim 1, wherein the control module stores a first range of motion of the first sensor module and a first equation for calculating the first movement value.

7. The physical exercise system of claim 1 further comprising a cloud-based application server remote to the first exercise machine and configured to receive the first movement value via a second communication connection, verify a user, produce data packets based on the first movement value and the verified user information, and transmit the data packets to the display device.

8. The physical exercise system of claim 7, wherein the cloud-based application server provides a first webpage accessible by the user, a second webpage accessible by a physical exercise instructor and a third webpage accessible by an operator of the first exercise machine.

9. The physical exercise system of claim 7 further comprises a user interface device including the display device placed in the vicinity of the exercise machine, the user interface device communicating with the cloud-based application server.

10. The physical exercise system of claim 7 further comprising an identification code affixed to the exercise machine and linked to the cloud-based application server.

11. The physical exercise system of claim 1 further comprising a second sensor module removably attached to a second moving part of the first exercise machine, the second sensor module being configured to detect movements by the second moving part and transmit the detected movements to the control module.

12. The physical exercise system of claim 11, wherein the control module store a second range of motion of the second sensor module and a second equation for calculating a second movement value from the detected movements of the second moving part, the second range of motion being different from the first range of motion and the second equation being different from the first equation.

13. The physical exercise system of claim 1 further comprising a third sensor module removably attached to a third moving part of a second exercise machine, the third sensor module being configured to detect movements by the third moving part and transmit the detected movements to the control module.

14. A method for retrofitting exercise machines, the method comprising:

removably attaching a sensor module to a moving part of an exercise machine, the sensor module being configured to detect movements of the moving part and transmit detected data by a first wireless communication connection, wherein the detected data includes angular acceleration changes of the moving part for determining a speed level of a motor that drives the moving part;

placing a control module in a vicinity, yet separated from the exercise machine, the control module being configured to receive the detected data through the first wireless communication connection, calculate an angle value using the detected data and transmit the angle value by a second wireless communication connection to a display device, and the control module being further configured to compare the angular acceleration changes with a predetermined threshold.

15. The method of claim 14 further comprising:

providing a cloud-based application server remote to the exercise machine, wherein the cloud-based application server is configured to receive the angle value via the second wireless communication connection, verify a user, produce data packets based on the angle value and the verified user information and transmit the data packets to the display device.

16. The method of claim 14 further comprising:

selecting a speed level of the motor;

adjusting the moving part to a beginning angle;

detecting an angular acceleration by the sensor module;

adjusting the moving part to an end angle; and estimating a speed range of the speed level.

17. The method of claim 14 further comprising:

calculating a sum of the angular acceleration changes for a predetermined time duration;

calculating an average angular acceleration from the sum; and determining the motor speed level corresponding to a speed range associated with the average angular acceleration.

18. The method of claim 17 further comprising ignoring the determined motor speed level when the angular acceleration change exceeds the predetermined threshold.

19. The method of claim 15 further comprising calibrating a range of motion of the sensor module and storing the range of motion in either the control module or the cloud-based application server.

20. The method of claim 15 further comprising transmitting a start token to the control module to start detecting and calculating the angle value when the user is verified by the cloud-based application server as a registered user;

transmitting an idle token to the cloud-based application server by the control module when there is no angle change being detected for a predetermined time period; and transmitting a stop token to the control module by the cloud-based application server after a plurality of angle changes being detected to meet a predetermined requirement stored in the cloud-based application server.

* * * * *